United States Patent [19]

Downey

[11] 4,035,976

[45] July 19, 1977

[54] SLEEVING FORM FOR MASONRY MATERIAL

[76] Inventor: Richard W. Downey, 635 Pine St., Lapeer, Mich. 48446

[21] Appl. No.: 683,845

[22] Filed: May 6, 1976

[51] Int. Cl.[2] ..... E04G 15/04; E04C 1/08

[52] U.S. Cl. ..... 52/577; 249/177; 52/127

[58] Field of Search ..... 52/577, 576, 704, 127, 52/309; 249/175, 177

[56] References Cited

U.S. PATENT DOCUMENTS

| | | | |
|---|---|---|---|
| 1,072,361 | 9/1913 | Rickman | 52/704 |
| 2,234,784 | 3/1941 | Stolz | 249/177 |
| 2,589,177 | 3/1952 | Wilhelm et al. | 249/175 |
| 2,684,518 | 7/1954 | Whitlock | 52/576 |
| 2,968,855 | 1/1961 | Stolz | 249/177 |
| 3,276,176 | 10/1966 | Jonsson et al. | 52/577 |
| 3,294,358 | 12/1966 | Hagedorn | 249/175 |
| 3,421,551 | 1/1969 | Currier | 52/577 |
| 3,933,336 | 1/1976 | Tolf | 249/177 |

*Primary Examiner*—Price C. Faw, Jr.
*Assistant Examiner*—James L. Ridgill, Jr.
*Attorney, Agent, or Firm*—Basile, Weintraub and VanOphem

[57] ABSTRACT

A sleeving assembly or form for forming voids in masonry comprises concentric tubular telescoping members. The members are formed from distinct density resinous materials which permit the inner member or core to be readily separated from the outer core.

8 Claims, 4 Drawing Figures

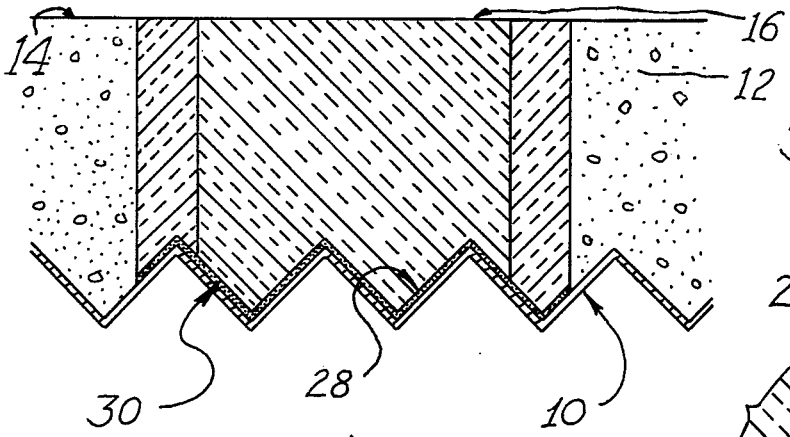
Fig. 1
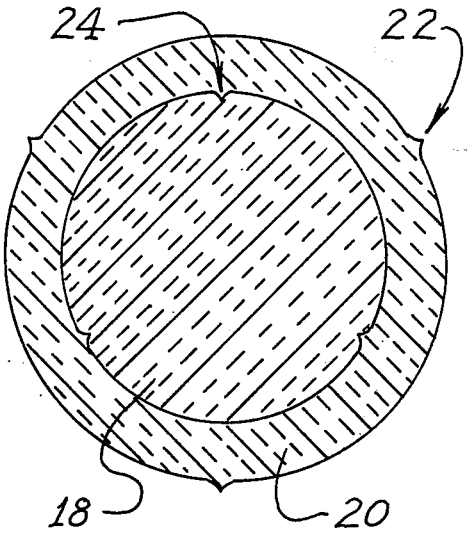
Fig. 4
Fig. 2
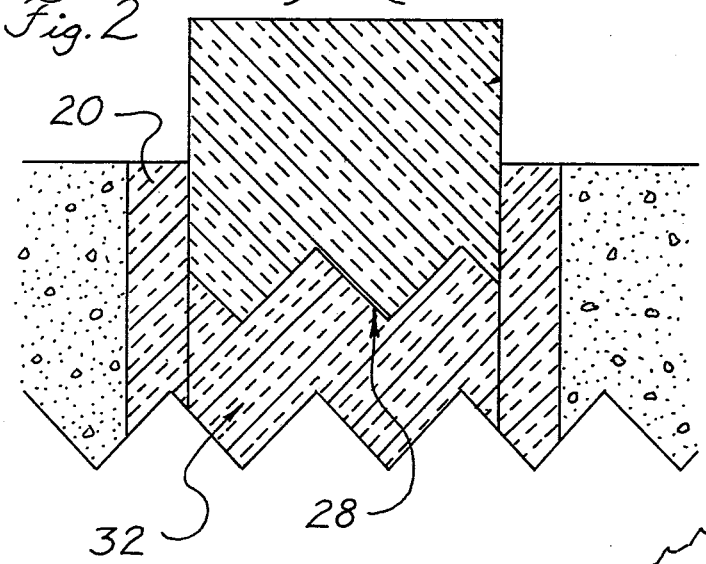
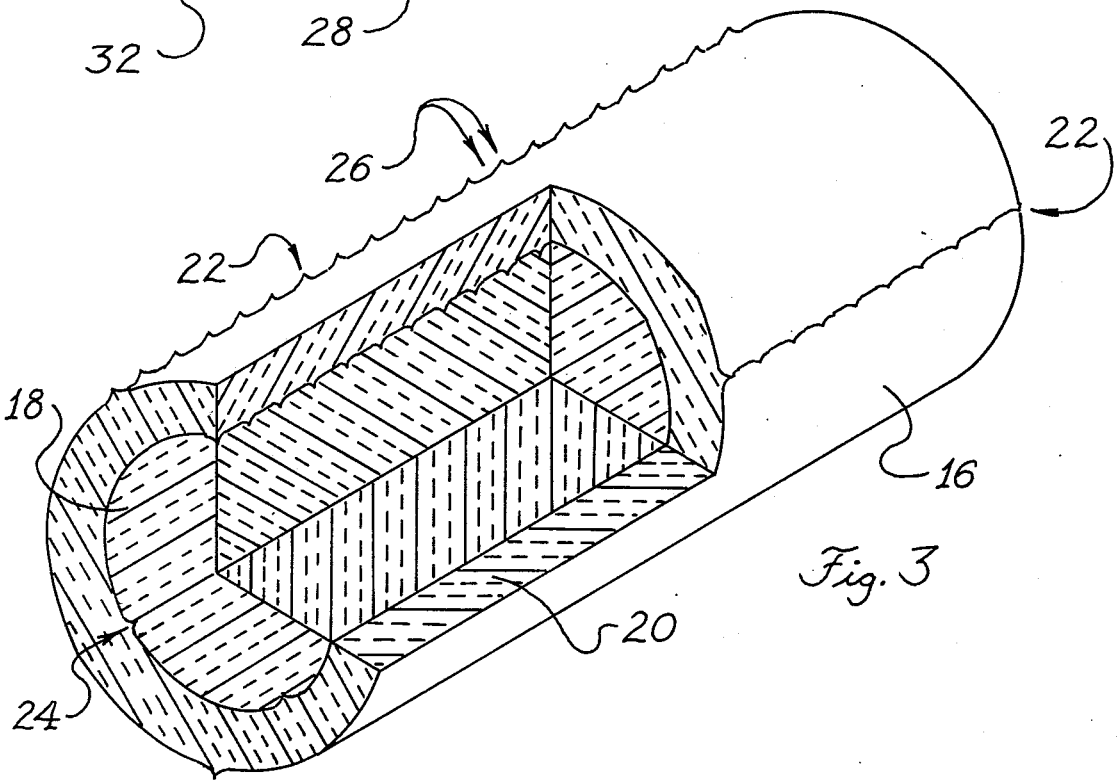
Fig. 3

SLEEVING FORM FOR MASONRY MATERIAL

BACKGROUND OF THE INVENTION

1. Field of the Invention

The present invention pertains to masonry construction. More particularly, the present invention pertains to means and methods for forming voids in masonry construction. Even more particularly, the present invention pertains to sleeving for forming voids in masonry construction.

2. Prior Art

As is known to those skilled in the art to which the present invention pertains, "sleeving" is the process by which a form of predetermined size and shape is disposed in such a manner as to permit the formation of a cavity in a masonry structure. According to the process, masonry, such as concrete, cement and the like is poured around the form. After the masonry material has hardened or cured the form is then removed. This leaves a void or cavity which is utilized for the installation of plumbing, heating and/or cooling pipes, electrical conduit, temperature control tubing and the like.

Heretofore, the prior art has proposed various types of forms or emplacement formers for forming cavities in maonry. See, inter alia, U.S. Pat. Nos. 2,202,147; 2,270,286 and 3,800,486. Generally, the prior art teaches cup-like members which have portions thereof which are removable to provide annular spaces, as well as cavities. The prior art devices, however, are inconvenient and quite often are impractical to manipulate. The present invention, on the other hand, is easily manipulated, convenient and, where necessary, provides an insulative annular ring. Without adversely affecting the forms for masonry structure, the present invention enables sleeving where formerly it was either impossible or impractical with the prior art means and modes. Furthermore, the present invention eliminates the need for core drilling.

SUMMARY OF THE INVENTION

In accordance with the present invention, there is provided a sleeving form or emplacement former for facilitating the formation of cavities in masonry. The sleeving form or former hereof comprises a concentric tubing arrangement. The tubing arrangement comprises a first or inner core and a second or outer annular core. The inner core telescopes within the outer core to facilitate the removal thereof.

The inner core is formed from a high density synthetic resinous material. The outer core is formed from a lower density synthetic resinous material. Each of the tubular cores has a uniform thickness.

The present invention, also, contemplates the outer core being an insulative material to insulate the annular area about the void left by the removal of the inner core.

For a more complete understanding of the present invention, reference is made to the following detailed description and accompanying drawing. In the drawing, like reference characters refer to like parts throughout the several views, in which:

BRIEF DESCRIPTION OF THE DRAWING

FIG. 1 is a side elevational view, partly in cross-section, depicting the deployment of the present invention;

FIG. 2 is a side elevational view similar to FIG. 1 but showing the removal of the inner core;

FIG. 3 is a cut-away perspective view of the sleeving of the present invention, and FIG. 4 is an end view of the present sleeving form.

DETAILED DESCRIPTION OF THE PREFERRED EMBODIMENT

Now, and with reference to the drawing, there is depicted therein a typical castable and hardenable floor formed from masonry materials. As is known to those skilled in the art, generally, a corrugated metal lattice work defines a subflooring 10 for supporting a poured masonry material. A masonry material 12 such as cement, concrete or the like is, then, poured onto the subflooring 10. After the poured material sets and hardens the supportive subflooring 10 is removed and there is, thus, provided a concrete floor 14.

In accordance with the present invention, voids or cavities are formed in the floor 14 by emplacing therewithin a sleeving form or emplacement former, generally, denoted at 16. The sleeving form 16 is emplaced or positioned on the subflooring 10 prior to pouring the masonry material.

The sleeving form 16 hereof comprises a concentric tubular assembly having a first or inner core 18 and a second or outer core 20. The outer core 20 defines an annular ring. The inner core 18 has a diameter substantially equal to the inner diameter of core 20. In this manner, the inner core 18 is telescopable within the outer core 20 (FIG. 2).

The inner core 18 is, preferably, formed from a high density synthetic resinous material. Useful materials include foamed friable materials, such as polystyrene, polyurethane foam, polyethylene, polyesters and the like. Preferably, the inner core is formed from a high density foamed, friable polystyrene.

The outer core is formed, preferably, from a lighter density foamed friable material. The materials enumerated hereinabove, when of a lighter density that the inner core are eminently useful in forming the outer core. Preferably, the outer core is formed from a lower density, foamed, friable polystyrene.

The friable nature of the materials enables the sleeving to be cut to any desired configuration and dimension. Furthermore, by virtue of the nature of the materials utilized, the annular outer core can function as an insulative layer about the periphery of the cavity formed hereby. This avoids the necessity of plugging the cavity or otherwise disposing insulation in the cavity. Also, because of the different densities in the materials defining the inner core and outer core, ease of separation therebetween is afforded.

In order to avoid possible separation of the outer core 20 from the poured masonry ridges 22 may be formed along the longitudinal extent thereof. The ridges 22 are integrally formed with the outer core on the exterior thereof and radiate outwardly thereform. Where utilized, the ridges 22 are equidistantly spaced about the circumference of the core. Preferably, three ridges are disposed about the exterior of the outer core.

Likewise the outer surface of the inner core can be provided with inwardly radiating ridges 24 to facilitate interlocking between the inner core and outer core. Alternatively, and although not shown in the drawing, the ridges 24 can project inwardly from and be formed on the interior surface of the outer annular ring or core. Also, the ridges 24 are disposed along the extent of thereof, as shown.

If desired, the ridges or protusions 22 and 24 can be provided with a peak and valley configuration 26, as shown.

In deploying the present sleeving form, a transverse cut is made therethrough to the desired length which is equal to the height of the floor to be poured. The cut can correspond to any irregular surfaces upon which the sleeving is to be placed. The ability to provide contoured cuts is attributable to the friable nature and cellular structure of the materials utilized to form the sleeving form. As exempletive of the deployment of the present invention, and as depicted in FIGS. 1 and 2, a section of sleeving form 16 is cut such that the bottom or cut-off base 28 of the form is contoured to the configuration of the corrugated subflooring 10. Thereafter, a mastic-type glue or paste adhesive 30 is applied to the base 28. The sleeving 16 is then placed on the subflooring 10. The adhesive holds the sleeving in position. Next, the masonry material 12 is poured and allowed to harden around the sleeving. After the masonry material has set and hardened the inner core is telescopingly separated from the outer core. This is achieved by applying an impact, such as by hitting, to the inner core. This breaks the bond of the adhesive existing between the inner core and the annular ring, as well as any frictional seals between the inner wall of the outer core and the exterior of the inner core. After impacting the inner core is then withdrawn, as shown in FIG. 2. Upon removal of the inner core, there is left a void 32 having a insulative annular ring defined by the outer core 20. If desired, the outer core can be removed by cutting it away from the masonry.

It should, also, be noted with respect hereto that pieces of unused sleeving form can be united to one another to provide a useful piece of the form, thus, eliminating waste. This is achieved by telescoping an unused piece of inner core into the interior of another piece of unused form in the space vacated by partially telescoping or dislodging the unused inner core in the another piece of form, and, then, abutting the two or more pieces together. The abutted pieces can then be glued or otherwise adhered to one another at their junction. Furthermore, pieces of unused inner core can be telescoped into unused pieces of outer core, thereby further reducing waste.

It is to be appreciated from the preceding that there has been described herein an efficient and utilitarian sleeving form for effectively forming voids in masonry material.

Without adversely affecting the forms for masonry structure, the present invention enables sleeving where formerly it was either impossible or impractical with the prior art means and modes. Furthermore, the present invention eliminates the need for core drilling.

Having, thus, described the invention, what is claimed is:

1. A sleeving form for forming a void in masonry material, comprising:

a. an inner core, and b. an outer annular core coextensive with and concentric with the inner core, the inner core having a diameter substantially equal to the inner diameter of the outer core, the inner core being telescopable into and out of the outer core wherein the inner core and the outer core are formed from a friable foamed plastic material.

2. The sleeving of claim 1 which further comprises:

a ridge formed along the extent of the outer surface of the outer core and radiating outwardly therefrom.

3. The sleeving of claim 1 which further comprises:

a ridge formed along the extent of the outer surface of the inner core and radiating inwardly therefrom.

4. The sleeving of claim 1 wherein:

the outer core defines an insulative annular layer about the periphery of the formed void upon the telescoping removal of the inner core from the outer core.

5. The sleeving of claim 1 wherein:

the material forming the inner core has a greater density than that of the material forming the outer core.

6. The sleeving of claim 5 wherein:

a. the inner form is formed from a high density foamed polystyrene, and b. the outer core is formed from a lighter density foamed polystyrene.

7. The sleeving of claim 1 wherein:

the inner core and the outer core are formed from a material selected from the group consisting of friable, foamed polystyrene, polyurethane, polyethylene and polyesters, the density of the inner core foam being greater than the density of the outer core foam.

8. The sleeving of claim 7 wherein:

the inner core and outer core are both formed from polystyrene.

* * * * *